US009703271B2

(12) United States Patent
Kim

(10) Patent No.: US 9,703,271 B2
(45) Date of Patent: Jul. 11, 2017

(54) WEARABLE ELECTRONIC DEVICE

(71) Applicant: Samsung Electronics Co., Ltd., Gyeonggi-do (KR)

(72) Inventor: Ju-Yong Kim, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 35 days.

(21) Appl. No.: 14/789,140

(22) Filed: Jul. 1, 2015

(65) Prior Publication Data

US 2016/0006201 A1 Jan. 7, 2016

(30) Foreign Application Priority Data

Jul. 1, 2014 (KR) ..... 10-2014-0081750

(51) Int. Cl.

| | |
|---|---|
| ***H01R 11/30*** | (2006.01) |
| ***G04G 19/00*** | (2006.01) |
| ***H01R 12/70*** | (2011.01) |
| ***H01R 13/62*** | (2006.01) |
| ***G04G 17/06*** | (2006.01) |
| *H01R 13/22* | (2006.01) |
| *H01R 107/00* | (2006.01) |

(52) U.S. Cl.

CPC ..... *G04G 19/00* (2013.01); *G04G 17/06* (2013.01); *H01R 12/7076* (2013.01); *H01R 13/6205* (2013.01); *H01R 13/22* (2013.01); *H01R 2107/00* (2013.01)

(58) Field of Classification Search

None

See application file for complete search history.

(56) References Cited

U.S. PATENT DOCUMENTS

| | | | | |
|---|---|---|---|---|
| 3,521,216 | A * | 7/1970 | Tolegian | H01R 13/6205 439/152 |
| 8,790,120 | B2 * | 7/2014 | Wang | H01R 13/6205 439/39 |
| 9,004,930 | B2 * | 4/2015 | Gualino | H01R 13/2421 439/136 |
| 9,077,105 | B2 * | 7/2015 | Kim | H01R 13/6205 |
| 2011/0092081 | A1 | 4/2011 | Gao et al. | |
| 2014/0287601 | A1 * | 9/2014 | Suh | H01R 13/6205 439/39 |

FOREIGN PATENT DOCUMENTS

KR 10-2012-0087953 A 8/2012

* cited by examiner

*Primary Examiner* — Tho D Ta

(74) *Attorney, Agent, or Firm* — Cha & Reiter, LLC

(57) ABSTRACT

Disclosed is a wearable electronic device including a movable connection terminal that is set back from an opening of a body housing when no external device is connected, and moves towards the opening when the external device approaches. The electronic device includes a body; a connection terminal located inside the body and provided to be movable from the inside towards a surface of the body; and a movable part coupled to or integrated with the connection terminal. The movable part may move the connection terminal towards the surface when a magnet of the external device approaches.

16 Claims, 9 Drawing Sheets

WEARABLE ELECTRONIC DEVICE

CLAIM OF PRIORITY

This application claims the priority under 35 U.S.C. §119(a) to Korean Application Serial No. 10-2014-0081750, which was filed in the Korean Intellectual Property Office on Jul. 1, 2014, the entire content of which is hereby incorporated by reference.

BACKGROUND

1. Technical Field

The present disclosure relates generally to an electronic device, and more particularly to a wearable electronic device and an improved connector thereof.

2. Description of the Related Art

Wearable electronic devices such as smart watches have recently become commercially available. In general, an electronic device refers to a device which performs a specific function corresponding to an installed program, such as a home appliance, electronic diary, portable multimedia player, mobile communication terminal, tablet PC, image/sound unit, desktop/laptop computer, navigation unit for a vehicle, and the like. Such electronic devices can output stored information through sounds and/or images. With higher integration and the popularization of hyper-speed and high capacity wireless communication, the functionality of common mobile communication terminals has expanded. For example, an entertainment function such as games, a multimedia function such as reproducing a music file and a video file, a communication and security function for mobile banking or the like, a scheduling function, an electronic wallet function, etc. are all integrated into a single electronic device, in addition to a communication function.

A portable electronic device, for example, an electronic diary, portable multimedia player, a mobile communication terminal, or tablet PC generally employs a flat display unit and a battery, and has a bar type, folder type, or slide type external appearance. With recent technological advances, electronic devices with desirable communication functions have become small enough to be worn on a part of the human body, such as a wrist or head. Thus an era of wearable electronic devices is beginning to emerge.

SUMMARY

The wearable electronic device may be provided with multimedia function modules for performing various functions. For example, the body temperature of a user may be measured, heart rates may be measured, or blood oxygen saturation may be provided. The wearable electronic device may be provided with a connection terminal connected to an external device, for transmitting and receiving data and/or supplying electronic power.

The connection terminal provided in the wearable electronic device may be located at a region exposed to an outer surface of the wearable electronic device such that the connection terminal is connected to the external device. In particular, the connection terminal may be provided on a rear surface of the wearable electronic device so as not to be exposed to the outside while the wearable electronic device is worn on the body of a user. Accordingly, if the wearable electronic device is worn on a part of the body of a user, the connection terminal is proximate the user's body and not exposed to the external environment.

However, if the user wears a wearable electronic device, the connection terminal may come into contact with the user's body. For example, when the wearable electronic device is of a watch type worn on a user's wrist, it frequently contacts sweat secreted from the user's wrist or moisture stuck to the wrist when the user washes his or her hands and foreign substances such as dust other than sweat or moisture may contact the connection terminal together with the moisture or sweat.

The connection terminal is a part electrically connected to an external device, and a connection error with an external device may be generated in the connection terminal when the connection terminal is contaminated or foreign substances stick to a periphery of the connection terminal.

Accordingly, various embodiments of the present disclosure provide a wearable electronic device which restricts a connection terminal of a wearable electronic device from contacting a user's body, and restricts the connection terminal from being exposed to sweat or moisture.

Various embodiments of the present disclosure also provide a wearable electronic device which can prevent a connection terminal from being contaminated by sweat or moisture.

Various embodiments of the present disclosure also provide a wearable electronic device which prevents wear of an external device when a connection terminal is connected to the external device and by which the external device can be precisely engaged with the connection terminal.

Various embodiments of the present disclosure also provide a wearable electronic device which can prevent a connection terminal from being exposed to the outside and can correct a design of an external appearance.

In various embodiments, a wearable electronic device includes a movable connection terminal that is set back from an opening of a body housing when no external device is connected to the connection terminal, and moves towards the opening when the external device approaches. The electronic device may include the body; the connection terminal located inside the body and provided to be movable from the inside towards a surface of the body; and a movable part coupled to or integrated with the connection terminal. The movable part may move the connection terminal towards the surface when a magnet of the external device approaches. The movable part may move the connection terminal back to the interior when the external device is detached.

In accordance with an aspect of the present disclosure, there is provided a wearable electronic device including: a body; a connection terminal located inside the body and provided to be movable from an inside to a surface of the body; and a movable part provided in the connection terminal and configured to move the connection terminal.

In accordance with another aspect of the present disclosure, there is provided an electronic device including: a body having an opening; a circuit board provided inside the body; a connection terminal located inside the body, electrically connected to the circuit board, and configured to be moved from an inside of the body to the opening; and a movable part provided in the connection terminal and configured to move the connection terminal from an inside of the body to the opening.

In the wearable electronic device according to various embodiments of the present disclosure, the connection terminal is covered when the wearable electronic device is worn on the body of a user so that the connection terminal is restricted from contacting the body of the user, and accordingly, the connection terminal can be restricted from being exposed to moisture according to sweat shedding from the body of the user or an in-use environment.

Further, since the connection terminal can be prevented from contacting sweat, moisture, or foreign substances, contamination of the connection terminal can be prevented and reliability of electrical connection of the connection terminal with the external device can be improved.

Furthermore, since the external device can be attached to the wearable electronic device while facing the wearable electronic device due to a pair of magnet members when the external device is located on a rear surface of the wearable electronic device, the external device can be prevented from moving, wear of a surface of the external device due to frequent attachments of the external device can be minimized, and the external device can be precisely engaged with the connection terminal to be coupled to the connection terminal.

In addition, a design of the external appearance of the wearable electronic device can be corrected by preventing the connection terminal from being exposed to the outside.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION

Figure 1A:
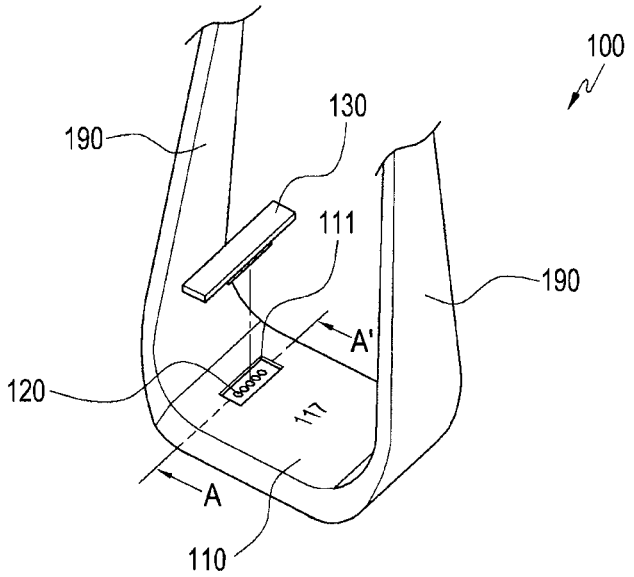
FIG. 1A is a view illustrating a wearable electronic device according to various embodiments of the present disclosure.

Various embodiments of the present disclosure will now be described more fully in conjunction with the accompanying drawings. The claimed subject matter may have various embodiments, and modifications and changes may be made therein. Therefore, the present disclosure will be described in detail with reference to particular embodiments shown in the accompanying drawings. However, the description is not intended to limit the claimed subject matter to the specific embodiments, and it shall be appreciated that all the changes, equivalents and substitutions in accordance with the principles taught herein and technical scope of the present disclosure are encompassed by the claimed subject matter. In description of the drawings, similar elements are indicated by similar reference numerals.

As used in various embodiments of the present disclosure, the expressions "include", "may include" and other conjugates refer to the existence of a corresponding disclosed function, operation, or constituent element, and do not limit one or more additional functions, operations, or constituent elements. Further, as used in various embodiments of the present disclosure, the terms "include", "have" and their conjugates may be construed to denote a certain characteristic, number, step, operation, constituent element, component or a combination thereof, but may not be construed to exclude the existence of or a possibility of addition of one or more other characteristics, numbers, steps, operations, constituent elements, components or combinations thereof.

Further, as used in various embodiments of the present disclosure, the expression "or" includes any or all combinations of words enumerated together. For example, the expression "A or B" may include A, may include B, or may include both A and B.

While expressions including ordinal numbers, such as "first" and "second", as used in various embodiments of the present disclosure may modify various constituent elements, such constituent elements are not limited by the above expressions. For example, the above expressions do not limit the sequence and/or importance of the elements. The expressions may be used to distinguish a component element from another component element. For example, a first user device and a second user device indicate different user devices although both of them are user devices. For example, without departing from the scope of the present disclosure, a first component element may be named a second component element. Similarly, the second component element also may be named the first component element.

It should be noted that if it is described that one component element is "coupled" or "connected" to another component element, the first component element may be directly coupled or connected to the second component, and a third component element may be "coupled" or "connected" between the first and second component elements. Conversely, when one component element is "directly coupled" or "directly connected" to another component element, it may be construed that a third component element does not exist between the first component element and the second component element.

The terms as used in various embodiments of the present disclosure are merely for the purpose of describing particular embodiments and are not intended to limit the various embodiments of the present disclosure. As used herein, the singular forms are intended to include the plural forms as well, unless the context clearly indicates otherwise.

Unless defined otherwise, all terms used herein, including technical terms and scientific terms, have the same meaning as commonly understood by a person of ordinary skill in the art to which various embodiments of the present disclosure pertain. Such terms as those defined in a generally used dictionary are to be interpreted to have the meanings equal to the contextual meanings in the relevant field of art, and are not to be interpreted to have ideal or excessively formal meanings unless clearly defined in various embodiments of the present disclosure.

An electronic device according to embodiments of the present disclosure may be a device including a communication function. For example, the electronic devices may include at least one of smart phones, tablet personal computers (PCs), mobile phones, video phones, e-book readers, desktop PCs, laptop PCs, netbook computers, personal digital assistants (PDAs), portable multimedia players (PMPs), MP3 players, mobile medical devices, cameras, wearable devices {e.g., head-mounted-devices (HMDs) such as electronic glasses}, electronic clothes, electronic bracelets, electronic necklaces, electronic appcessories, electronic tattoos, or smart watches.

According to some embodiments, the electronic device may be a smart home appliance with a communication function. The smart home appliances may include at least one of, for example, televisions, digital video disk (DVD) players, audio players, refrigerators, air conditioners, cleaners, ovens, microwaves, washing machines, air purifiers, set-top boxes, TV boxes (e.g., HomeSync™ of Samsung, Apple TV™, or Google TV™), game consoles, electronic dictionaries, electronic keys, camcorders, or electronic frames.

According to some embodiments, the electronic device may include at least one of various medical appliances (e.g., magnetic resonance angiography (MRA), magnetic resonance imaging (MRI), computed tomography (CT), and ultrasonic machines), navigation equipment, a global positioning system (GPS) receiver, an event data recorder (EDR), a flight data recorder (FDR), automotive infotainment device, electronic equipment for ships (e.g., ship navigation equipment and a gyrocompass), avionics, security equipment, a vehicle head unit, an industrial or home robot, an automatic teller machine (ATM) of a banking system, and a point of sales (POS) of a shop.

According to some embodiments, the electronic device may include at least one of a part of furniture or a building/structure having a communication function, an electronic board, an electronic signature receiving device, a projector, and various kinds of measuring instruments (e.g., a water meter, an electric meter, a gas meter, a radio wave meter, and the like). The electronic device according to various embodiments of the present disclosure may be a combination of one or more of the aforementioned various devices. Further, the electronic device according to various embodiments of the present disclosure may be a flexible device. Further, it will be apparent to those skilled in the art that the electronic device according to various embodiments of the present disclosure is not limited to the aforementioned devices.

As a wearable electronic device according to various embodiments of the present disclosure, a wearable electronic device such as a smart watch or a body signal measurement device may be exemplified. The wearable electronic device may perform an operation through communication with an external device such as a server or interworking with an external electronic device. For example, an image captured by a camera of the wearable electronic device and/or location information detected by a sensor unit may be transmitted to the server through a network, and data transmitted to the interworking electronic device may be stored and displayed in conjunction with the wearable electronic device. The network may be a mobile or cellular communication network, a Local Area Network (LAN), a Wireless Local Area Network (WLAN), a Wide Area Network (WAN), an Internet, a Small Area Network (SAN) or the like, but is not limited thereto.

The electronic device interworking with the wearable electronic device may include a smartphone, a mobile phone, a navigation device, a gaming device, a TV, a vehicular head unit, a notebook computer, a laptop computer, a tablet computer, a Personal Media Player (PMP), and a Personal Digital Assistants (PDA), and may be another wearable electronic device. The electronic device may be implemented as a portable communication terminal which has a wireless communication function and is pocket-sized. The electronic device may be a flexible device or have a flexible display unit.

Hereinafter, a wearable electronic device according to various embodiments of the present disclosure will be discussed with reference to FIGS. 1A to 11. The term 'user' used in the various embodiments of the present disclosure may refer to a human who uses an electronic device or a device which uses an electronic device (for example, an artificial intelligence electronic device).

According to one of various embodiments of the present disclosure, a wearable electronic device includes: a body; a connection terminal located inside the body and which may be moved from the inside the body to the surface; and a movable part coupled to or integrated with the connection terminal and configured to move the connection terminal.

According to one of various embodiments of the present disclosure, an electronic device includes: a body having an opening; a circuit board provided inside the body; a connection terminal located inside the body, electrically connected to the circuit board, and configured to be moved from an inside of the body to the opening; and a movable part coupled to or integrated with the connection terminal and configured to move the connection terminal from an inside of the body to the opening.

According to one of various embodiments of the present disclosure, the electronic device further includes a connection board provided between the connection terminal and the circuit board, configured to electrically connect the connection terminal and the circuit board, and provided to be moved as the connection terminal is moved.

According to one of various embodiments of the present disclosure, the connection board includes: at least one first board part; and a flexible second board part electrically connected to the first board part and configured to move the first board part between an internal circuit board and the connection terminal.

According to one of various embodiments of the present disclosure, the electronic device further includes a first member provided inside the body and configured to fix the movable part in place.

According to one of various embodiments of the present disclosure, the electronic device further includes an external device provided on a rear surface of the body to be attached to or detached from the rear surface of the body, coupled to the rear surface of the body to be electrically connected to the connection terminal, and configured to move the connection terminal toward the opening.

According to one of various embodiments of the present disclosure, the external device includes: a terminal module electrically connected to the connection terminal; and a second member provided at a periphery of the terminal module, configured to separate the movable part attached to the first member and move the movable part toward the opening, and attached to the body surface proximate to the movable part.

According to one of various embodiments of the present disclosure, if the external device is provided on a rear surface of the body while the movable part is attached to the first member, the movable part is separated from the first member by the second member and is attached to a body surface proximate the second member.

According to one of various embodiments of the present disclosure, the movable part includes a first magnet member, the first member includes a second magnet member configured to generate an attractive force with the first magnet member, the third member includes a third magnet member configured to generate an attractive force with the first magnet member, and the third magnet member has a magnetic force larger than that of the second magnet member.

According to one of various embodiments of the present disclosure, the movable part includes a metal member, the first member includes a second magnet member configured to generate an attractive force with the metal member, the second member includes a third magnet member configured to generate an attractive force with the metal member, and the third magnet member has a magnetic force larger than that of the second magnet member.

According to one of various embodiments of the present disclosure, the movable part includes a first magnet member, the first member includes a metal member attached according to a magnetic force of the first magnet member, the second member includes a third magnet member configured to generate an attractive force with the first magnet member, and a magnetic force between the first magnet member and the third magnet member is larger than a magnetic force between the first magnet member and the metal member.

According to one of various embodiments of the present disclosure, if the external device is mounted on the rear surface of the body, the movable part is separated from the first member, and is fixed to the second member while being moved to the rear surface of the body, and the connection terminal is exposed from the circuit board to a surface of the opening to be electrically connected to the terminal module as the movable part is moved.

According to one of various embodiments of the present disclosure, a cover is further provide at the opening.

According to one of various embodiments of the present disclosure, the opening is located on one surface of the body, and the cover is provided at the opening to be attached to or detached from the opening.

According to one of various embodiments of the present disclosure, the cover includes: an adhering member introduced into the opening and configured to seal the opening; and a bottom member provided on one surface of the rubber housing and extending to a circumference of the rubber housing to be attached to a periphery of the opening such that the opening is sealed.

According to one of various embodiments of the present disclosure, the cover is formed of a rubber material.

Hereinafter, a wearable electronic device according to various embodiments of the present disclosure will be described with reference to FIGS. 1A to 11.

FIG. 1A is a perspective view illustrating a wearable electronic device 100 according to various embodiments of the present disclosure. An apparatus according to the present disclosure may include wearable electronic device 100 and an external device (e.g. 200, described below) connected thereto for supplying electric power to device 100 and/or transmitting and receiving data to and from device 100. In the following description, a watch type wearable device worn on a wrist of a user will be exemplified as the wearable electronic device 100. However, as noted above, wearable electronic device 100 can alternatively be embodied as any wearable device such as an electronic bracelet, necklace, etc. Further, the present technology may also be applied to non-wearable electronic devices.

Device 100 may include a body 110 with a hollow interior, a rear surface 117 of the body 110, and a connection terminal 120 disposed within an opening 111 of rear surface 117. A cover 130 may cover the opening 111 when device 100 is not connected to any external device. When embodied as an electronic watch, wrist straps 190 are provided.

Figure 1B:
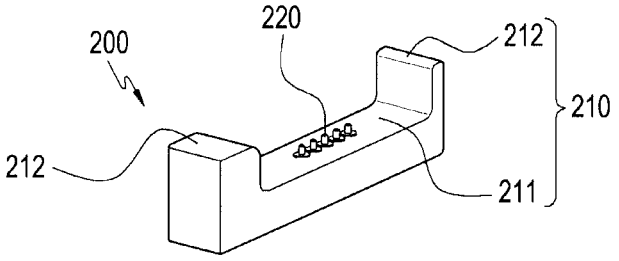
FIG. 1B is a view illustrating an external device electrically connectable to the wearable electronic device.

FIG. 1B is a perspective view of an example external device, 200, which may connect to device 100 so as to provide electric power to and/or exchange data with device 100. External device 200 includes a terminal module 220 and a body housing 210 which includes a fixing surface 211 and a pair bosses 212. Further description is provided below.

Figure 2A:
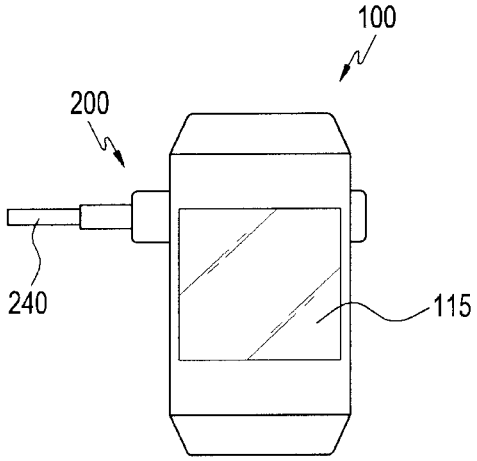
FIG. 2A, FIG. 2B and FIG. 2C are respective perspective views illustrating a state in which an external device including a cable type connection line is mounted on a wearable electronic device according to one of various embodiments of the present disclosure.
Figure 2B:
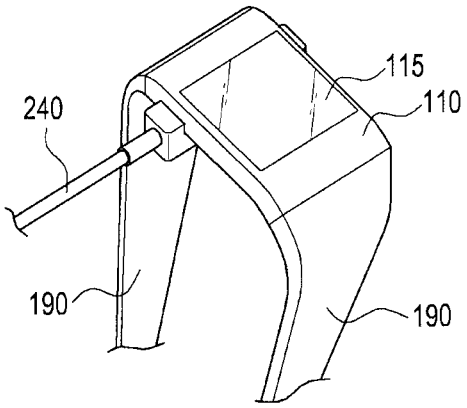
Figure 2C:
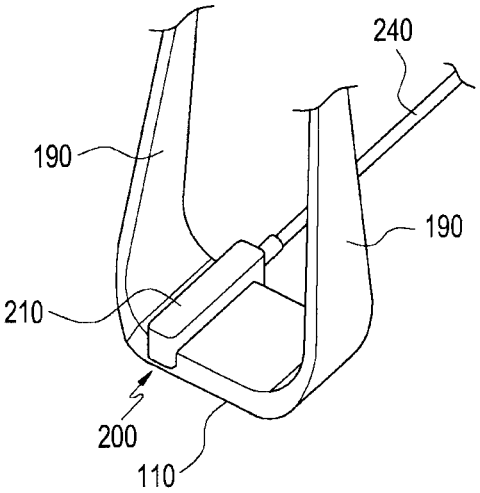

FIGS. 2A, 2B and 2C are different perspective views illustrating a state in which an external device including an attached cable type connection line is mounted on a wearable electronic device according to one of various embodiments of the present disclosure. In these examples, electronic device 100 is further illustrated as having a display 115 on a front face. External device 200 is connected to device 100 and has a cable line 240.

Figure 3:
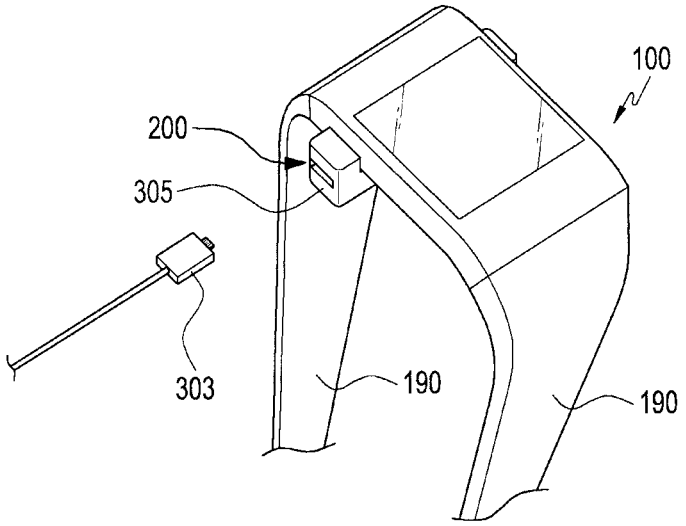
FIG. 3 is a view illustrating a state in which an external device including a gender type connection line is mounted on a wearable electronic device according to one of various embodiments of the present disclosure.

FIG. 3 is a view illustrating a state in which an external device including a gender type connection line is mounted on a wearable electronic device according to one of various embodiments of the present disclosure. External device 200 includes a gender connector 305 which connects to an external cable that has a complementary connector 303.

Figure 4A:
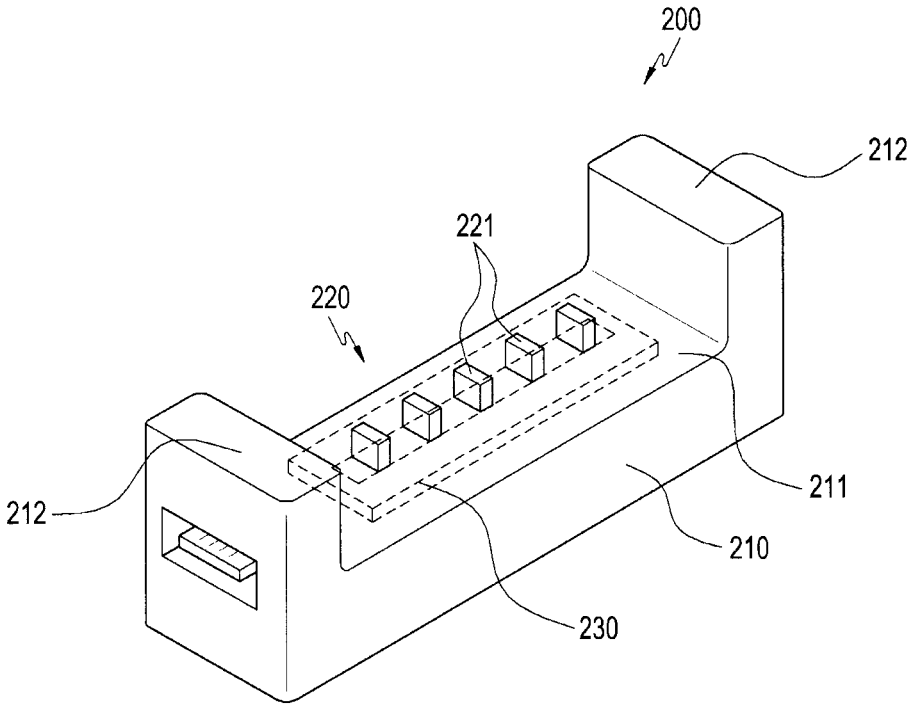
FIG. 4A is a perspective view illustrating an external device connectable to a wearable electronic device according to one of various embodiments of the present disclosure.
Figure 4B:
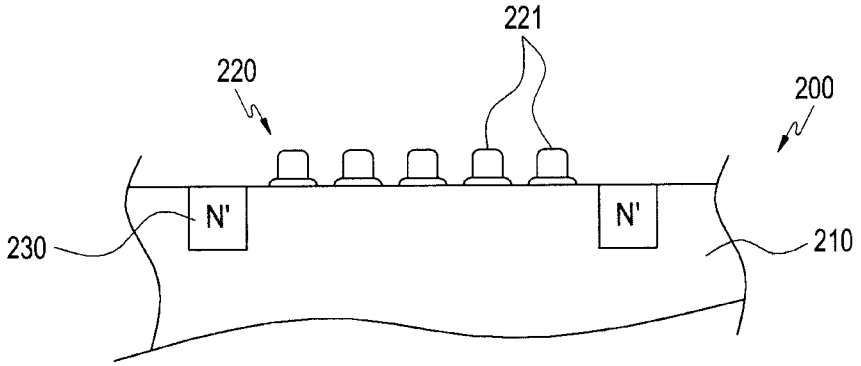
FIG. 4B is a cross sectional view taken along a longitudinal axis of the external device of FIG. 4A.

FIG. 4A is a perspective view illustrating an embodiment of external device 200. FIG. 4B is a cross-sectional view of external device 200, taken along a longitudinal center line of FIG. 4A. Referring to FIGS. 2A to 4B, external device 200 may have a C-shape which is sized to surround a portion of the rear surface 117 of the electronic device 100 and opposite side surfaces thereof. In the example shown, an upper side of rear surface 117 is surrounded by external device 200.

The external device 200 may include a body housing 210 and a connection line extending from one side of the body housing 210. The body housing 210 may be attached to and detached from the rear surface 117 of electronic device 100.

The body housing 210 may include positioning part 211 on which the wearable electronic device 100 is positioned, and the pair of fixing bosses 212 provided at opposite ends of the positioning part 211, for preventing movement of the wearable electronic device 100 mounted to the positioning part 211 and fixing the wearable electronic device 100.

The body housing 210 may be provided with a set of terminals ("terminal module") 220 and a "second member" 230. (A first member, which is part of device 100, is discussed later.) Terminal module 220 may include a number of terminals 221 which are shown as pins (but may alternatively be sockets).

The terminal module 220 may be provided outside the body housing 210, e.g., on a surface of the positioning part 211 to be exposed. The terminal module 220 may be electrically connected to the connection terminal 120 of the wearable electronic device 100, which will be described below. If the external device 200 is attached to the rear surface 117 of the wearable electronic device 100, the body 110 of the wearable electronic device 100 may be positioned on the positioning part 211 between the fixing bosses 212. The terminal module 220 may be electrically connected to the connection terminal 120 when devices 100 and 200 are brought into contact. Terminals 221 (e.g., pins) of terminal module 220 may electrical connect to respective terminals 121 (e.g., sockets) of connection terminal 120 (alternatively, terminals 221 are sockets and terminals 212 are pins).

The second member 230 may be mounted around a periphery of the terminal module 220 inside the body housing 210. The second member 230 may include or be composed entirely of a magnet (denoted "N" for a north pole), which provides an attractive force to a magnetic movable part within device 100, described below, which is engaged with connector module 120. In this manner, connector module 120 may be moved towards the second member 230 when external device 200 is placed close to device 100. More particularly, as will be described in detail below, a force is provided such that a movable part 140 (seen in FIGS. 10 and 11) removably attached to a first member 160 of the body 110 may be moved towards the second member 230 by the driving force between the second member 230 and the movable part 140 (due to an attractive force between magnet members in the examples herein). The second member 230 may become attached to the movable part 140 by the driving force generated between the second member 230 and the movable part 140 moved to the second member 230. Accordingly, if the external device 200 is mounted to the wearable electronic device 100, a connection between the respective terminals 221 and 121 may be facilitated and firmly made by means of the driving force between the second member 230 and the movable part 140. As such, the external device 200 may be prevented from separating from the wearable electronic device 100 while remaining attached to the wearable electronic device 100. The second member 230 will be described in detail in the description of a configuration of the movable part 140 together, but may include a magnet as noted above. An attractive force between the first member 160 and the movable part 140 may be less than the driving force between the second member 230 and the movable part 140 such that the second member 230 may have a driving force by which the movable part 140, temporarily fixed in place via attachment to the first member 160, is separated from the first member 160 and is moved towards the second member 230. Further details will be described below.

The connection line 240 may have a cable type form or a gender type form as noted earlier.

Figure 5:
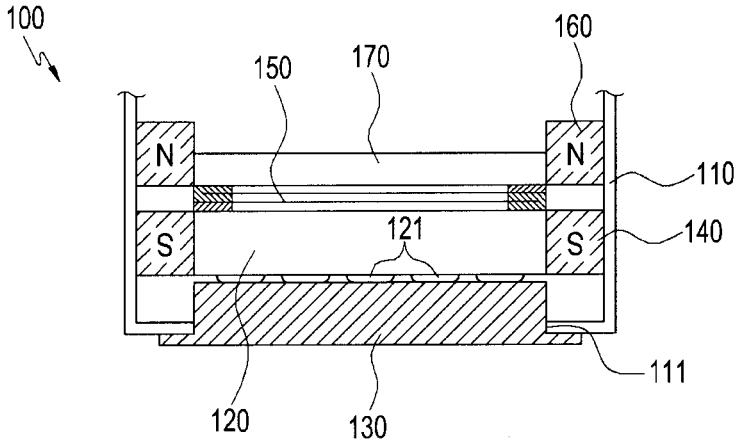
FIG. 5 is a view illustrating a wearable electronic device according to one of various embodiments of the present disclosure and a cover provided in the wearable electronic device.
Figure 6:
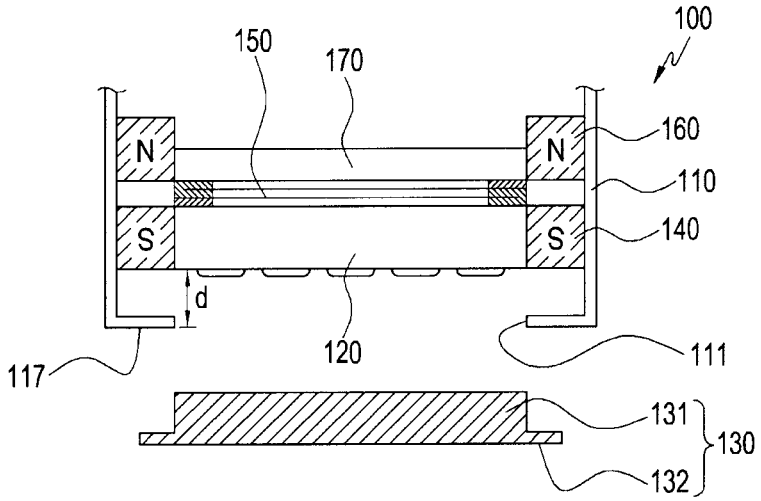
FIG. 6 is a view illustrating a wearable electronic device of FIG. 5 shown apart from the cover.

FIG. 5 is a cross-sectional view illustrating an example of wearable electronic device 100 with an antifungal cover covering the connection terminal 120. FIG. 6 is a cross-sectional view illustrating electronic device 100 with the cover shown separated from device 100.

Referring to FIGS. 5 and 6, device 100 is constructed to prevent the connection terminal 120 from contacting the body of a user, since connection terminal 120 is set back by a distance "d" from the rear surface 117 of the device 100 when external device 200 is detached and disconnected, by means of the moving part 140. That is, when external device 200 is detached, magnets N and S shown in FIGS. 5 and 6 attract one another, and since magnet S is engaged with connector 120, it pulls back connector 120 from the rear surface 117 by the distance d as the moving part 140 is retracted back. In this state, a cover 130 with a protruding central section may seal an opening 111, thereby preventing the connection terminal from exposure to an external environment. The configuration may allow the connection terminal 120 to be exposed to an external environment only while the wearable electronic device 100 is connected to the external device 200.

Specifically, to achieve this, device 100 may include a body 110, a fastening member (e.g. wrist straps) through which the body 110 is worn on the body of a user, a circuit board 170 within body 110, connection terminal 120, movable part 140, and cover 130.

The body 110 has a configuration allowing device 100 to be worn on a user's body to realize various functions. A display unit 115 (see FIG. 2A) including a touch panel may be provided on the front surface of the body 110 to allow a user to identify a screen or realize an input, and various modules such as a camera, a mechanical input button, a speaker, and a microphone may be mounted around a periphery of the display unit 115.

Circuit board 170 employing modules for various multi-functions, connection terminal 120 electrically connected to the external device 200, and movable part 140 for imparting translational movement to connection terminal 120 from an interior of the body 110 to the opening 111 in a rear wall of the body 110, which will be described below, may be mounted inside the body 110. Cover 130 may be provided to cover the opening 111 such that the opening 111 can be sealed.

A first member 160 for generating an attractive force may be provided between the circuit board 170 and the movable part 140 around the circuit board 170. First member 160 may have a shape of a picture frame or a donut surrounding circuit board 170. The movable part 140 is removably attachable to the first member 160 by an attractive force between the movable part 140 and the first member 160. FIGS. 5 and 6 illustrate a state in which no external device 200 is connected to device 100, and first member 160 is attached to movable part 140. In this state, the terminals 121 of connection terminal 120 remain electrically connected to respective circuit points on the circuit board 170. Note that the mounting location of the first member 160 may be arbitrarily changed, as long as the first member 160 is attachable to the movable part 140 such that the connection terminal 120 is mounted inside of the body 110 to be close to the circuit board 170. An opening 111 may be provided in one surface of the body 110, preferably in the rear surface 117 of the body 110 as illustrated. As illustrated later in connection with FIG. 10, the connection terminal 120, located inside the opening 111, may be pulled to the opening 111, i.e., to a plane coinciding with the bottom surface 117 when the moving part 140 moves via attraction by the external device 200's magnet. When the connection terminal 120 is pulled to the opening 111, it may be exposed to the outside of the rear surface 117 of the body 110 through the opening 111.

The cover 130 may be detachably provided at the opening 111. Cover 130 is inserted into and positioned at the opening 111 to be engaged with the periphery of the opening 111 such that the opening 111 may be sealed. The cover 130 has a configuration for covering the connection terminal 120 such that the connection terminal 120 located inside the opening 111 may not be exposed to an external environment.

The cover 130 according to an embodiment of the present disclosure may include an adhering member 131 and a bottom member 132.

The adhering member 131 is introduced into the opening 111, and a circumferential surface of the adhering member 131 is adhered to a periphery of the opening 111 to seal the opening 111. The adhering member 131 may be formed of a rubber material.

The bottom member (interchangeably, "flange member") 132 is provided on one surface of the adhering member 131, and extends from a circumference of the adhering member 131 to be wider than a circumferential surface of the adhering member 131. When the adhering member 131 is introduced into the opening 111, the bottom member 132 may be engaged with a circumferential surface of a periphery of the opening 111 to be adhered to rear surface 117 of the body 110. If the bottom member 132 is adhered to a periphery of the opening 111, the opening 111 may be effectively sealed from foreign substances, such as sweat and water, which move towards the opening 111 as the wearable electronic device is worn on a user's body. The bottom member 132 may be formed of the same material as the adhering member 131, and may be formed of dissimilar materials. For example, the bottom member 132 may be formed of the same rubber material as that of the adhering member 131, and may be formed of a metallic material or a plastic material in consideration of design or external appearance when the bottom member is mounted on a rear surface of the body 110. When the bottom member 132 is formed of a metallic material or a plastic material, a material such as silicon or rubber may be further provided on a surface facing a circumferential surface of a periphery of the opening 111 to seal a space between the bottom member 132 and the circumferential surface of the periphery of the opening 111. Accordingly, various material options are available for the bottom member 132.

The connection terminal 120 is located inside the body 110, and is electrically connected to the circuit board 170. The connection terminal 120 may be moved from inside body 110 toward the opening 111 while remaining electrically connected to the circuit board 170 as the external device 200 is brought into contact with the body 110.

While the external device 200 is detached from device 100, the connection terminal 120 may be mounted inside the body 110, set back at a distance d from the rear surface 117, while being attached to the circuit board 170.

While the external device 200 is mounted on the wearable electronic device 100 (see FIG. 10), the connection terminal 120 may be pulled from inside the body 110 toward the opening 111 to be engaged with a rear wall of body 110 at the periphery of the opening 111. In this condition, a surface of the connection terminal 120 and terminals 121 mounted on the surface may be exposed to the outside through opening 111, and make electrical contact with respective terminals 221 of the external device 200.

Figure 7:
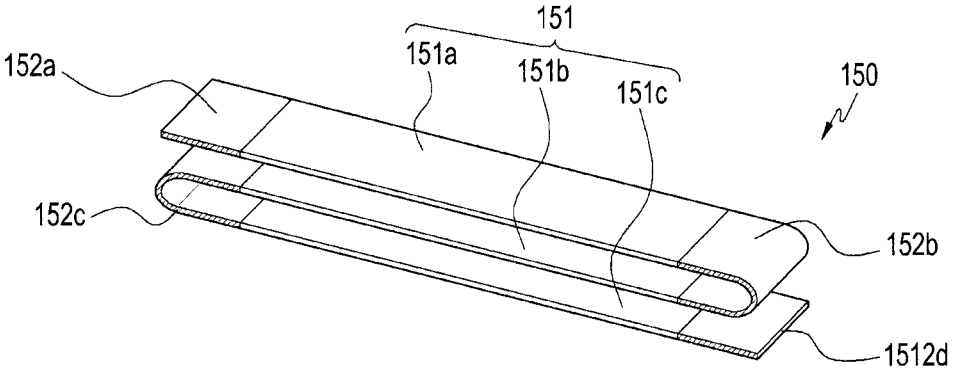
FIG. 7 is a view illustrating a state in which a connection board of an electronic device according to an embodiment of the present disclosure is folded between a circuit board and a connection terminal.
Figure 8:
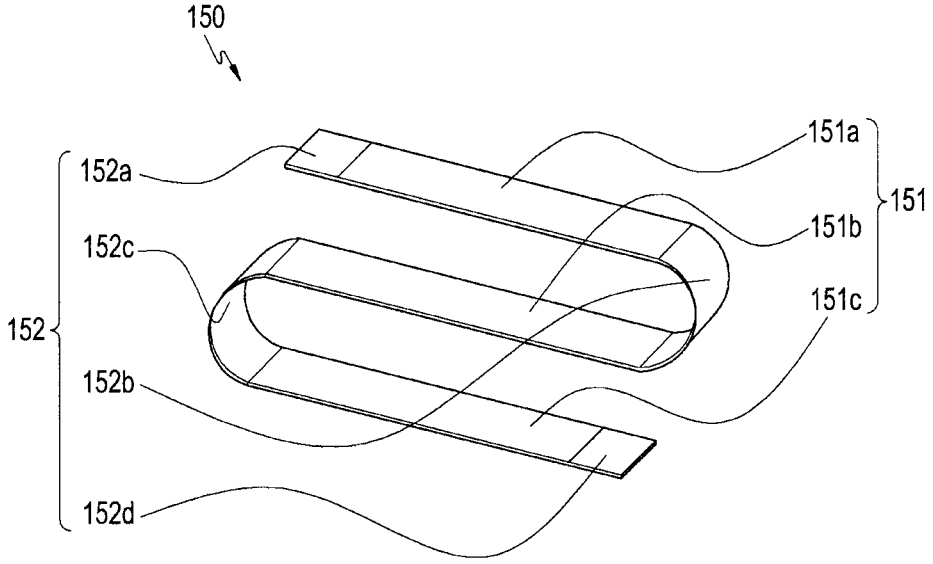
FIG. 8 is a view illustrating a state in which a connection board of an electronic device according to an embodiment of the present disclosure is unfolded between a circuit board and a connection terminal.

FIG. 7 is a view illustrating a state in which a connection board of an electronic device including an antifungal cover according to an embodiment of the present disclosure is folded between a circuit board and a connection terminal. FIG. 8 is a view illustrating a state in which a connection board of an electronic device including an antifungal cover according to an embodiment of the present disclosure is unfolded between a circuit board and a connection terminal.

Referring to FIGS. 7 and 8, a connection board 150 may be provided between the connection terminal 120 and the circuit board 170. Connection board 150 electrically connects the circuit board 170 to the connection terminal 120. As illustrated, connection board 150 may have a meandering configuration that unfolds and folds, with one end 152*a* remaining connected to circuit board 170 and an opposite end 152*d* remaining connected to connection terminal 120 in all states of folding and unfolding. Thus, connection board 150 may move away from or closer to the circuit board 170 while the connection terminal 120 remains electrically connected to the circuit board 170.

The connection board 150 may include a first board part 151 and a second board part 152. The first board part 151 is a configuration provided between the connection terminal 120 and the circuit board 170, and may be formed of a hard material to prevent twisting as the connection board 150 is moved.

The second board part 152 is electrically connected to the first board part 151, and is formed of a flexible material. The second board part 152 may include flexible boards 152*a* and 152*c* located at one side of the first board part 151 and flexible boards 152*b*, 152*d* located on an opposite side of first board part 151. The first board part 151 may include three boards 151*a*, 151*b* and 151*c*. Since the second board part 152 is flexible, the second board part 152 may allow the connection board 150 to move through deformation of the second board part 152, for example, as the second board is folded to or unfolded from an end of the first board part 151 when the connection terminal 120 is moved between the circuit board 170 and the opening 111.

Second board part 152 may electrically connect the boards 151*a*, 151*b*, 151*c* and electrically connect these boards to the circuit board 170 and the connection terminal 120 as well. As noted above, the second board part 152 according to an example may include a total of four boards, that is, a first flexible board 152*a*, a second flexible board 152*b*, a third flexible board 152*c*, and a fourth flexible board 152*d*. The first flexible board 152*a* is provided on one end of the first board 151*a* to electrically connect the circuit board 170 and the first board 151*a*. Second flexible board 152*b* is provided between the first board 151*a* and the second board 151*b* to electrically connect the first board 151*a* and the second board 151*b*. Third flexible board 152*c* is provided between the second board 151*b* and the third board 151*c* to electrically connect the second board 151*b* and the third board 151*c*. Fourth flexible board 152*d* is provided between the third board 151*c* and the connection terminal 120 to electrically connect the third board 151*c* and the connection terminal 120.

In a description of the first board part 151 and the second board part 152, the circuit board 170, the first board 151*a*, the second board 151*b*, the third board 151*c*, and the connection terminal 120 are sequentially stacked, in a state in which the flexible board 151*a* is connected to the circuit board 170 and one end of the first board 151*a*, the second flexible board 151*b* is provided between an opposite end of the first board 151*a* and one end of the second board 151*b* to be folded, the third flexible board 151*c* is provided between an opposite end of the second board 151*b* and one end of the third board 151*c* to be folded, and the fourth flexible board 151*d* is provided between the one end of the third board 151*c* and the connection terminal 120.

While the circuit board 170, the first board part 151, the second board part 152, and the connection terminal 120 stacked in this way are provided inside the body 110, the connection terminal 120 may be moved toward the opening 111. The connection terminal 120 is moved toward the opening 111, and while one end of the first flexible board 151*a* is coupled to the circuit board 170, an opposite end of the first flexible board 151 is moved away from the circuit board 170 as the first board 151*a* is moved. The second flexible board 151*b* folded between the first board 151*a* and the second board 151*b* is unfolded, and the second board 151*b* is moved away from the first board 151*a*. The third flexible board 151*c* is unfolded between the second board 151*b* and the third board 151*c*, and the third board 151*c* is moved away from the second board 151*b*. While one end of the fourth flexible board 151*d* is coupled to the third board 151*c*, an opposite end of the fourth flexible board 151*d* is moved away from the third board 151*c* as the connection board 120 is moved.

Accordingly, if the connection terminal 120 is moved from the circuit board 170 toward the opening 111, the connection board 150 may be moved while the connection terminal 120 remains electrically connected to the circuit board 170 as the connection board 150 is folded or unfolded like a spring between the circuit board 170 and the connection terminal 120.

Figure 9:
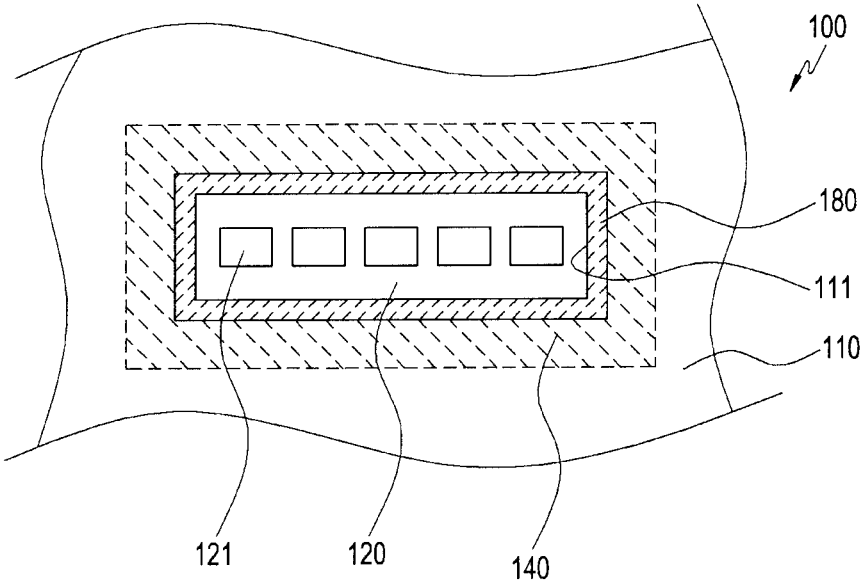
FIG. 9 is a view illustrating a movable part of a wearable electronic device according to one of various embodiments of the present disclosure and a connection terminal coupled to the movable part.

FIG. 9 is a view illustrating an embodiment of a movable part within wearable electronic device 100 according to an example. Movable part 140 may be provided integrated with the connection terminal 120, and causes movement of the connection terminal 120 between the circuit board 170 and the opening 111. As illustrated, the movable part 140 according to an example may be provided around a periphery of the connection terminal 120 to have a picture frame or donut shape. Accordingly, an opening in which the connection terminal 120 is positioned is provided in an interior of the movable part 140, and the connection terminal 120 is positioned in the opening and mechanically coupled to movable part 140 such that the connection terminal 120 moves as the movable part 140 moves. In an example, a resilient coupling part 180 such as silicon or rubber may be provided between the connection terminal 120 and the movable part 140. The resilient coupling part 180 may be adhered to both a periphery of the connection terminal 120 and an inner surface of the movable part 140 to couple the movable part 140 and the connection terminal 120. Although it has been exemplified in the embodiment of the present disclosure that the movable part 140 may have a donut shape and the connection terminal 120 may be mounted at the center of the connection terminal 120, other configurations are available. For example, the shape or structure of the movable part 140 may be modified, e.g., movable part 140 may be alternatively mounted in separated at opposite ends of the connection terminal 120. Although it has been exemplified that the resilient coupling part 180 is provided between the connection terminal 120 and the movable part 140 to couple the connection terminal 120 and the movable part 140, other configurations are available. For example, the resilient coupling part 180 may be arbitrarily modified, as long as the connection terminal 120 is suitably attached to the movable part 140.

Figure 10:
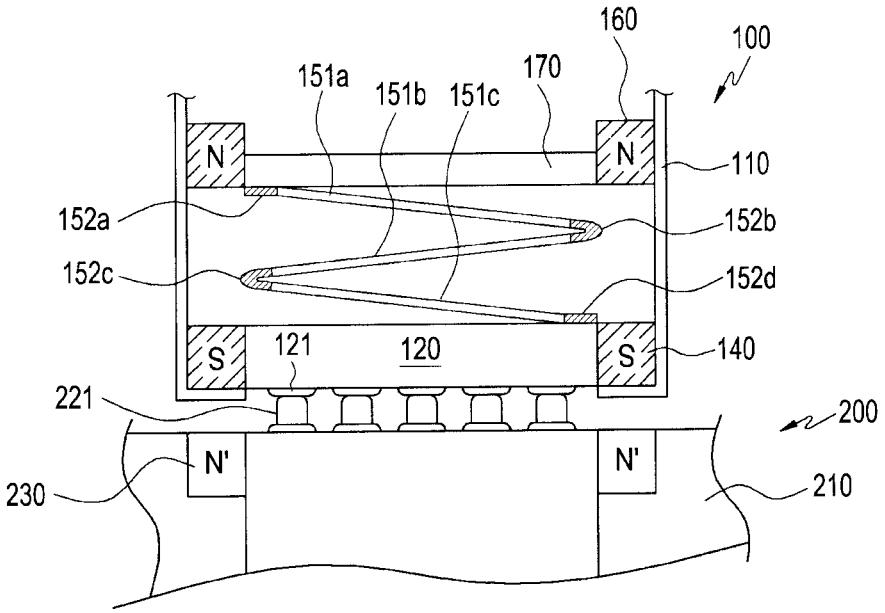
FIG. 10 is a view illustrating a state in which an external device is coupled to a wearable electronic device according to one of various embodiments of the present disclosure.
Figure 11:
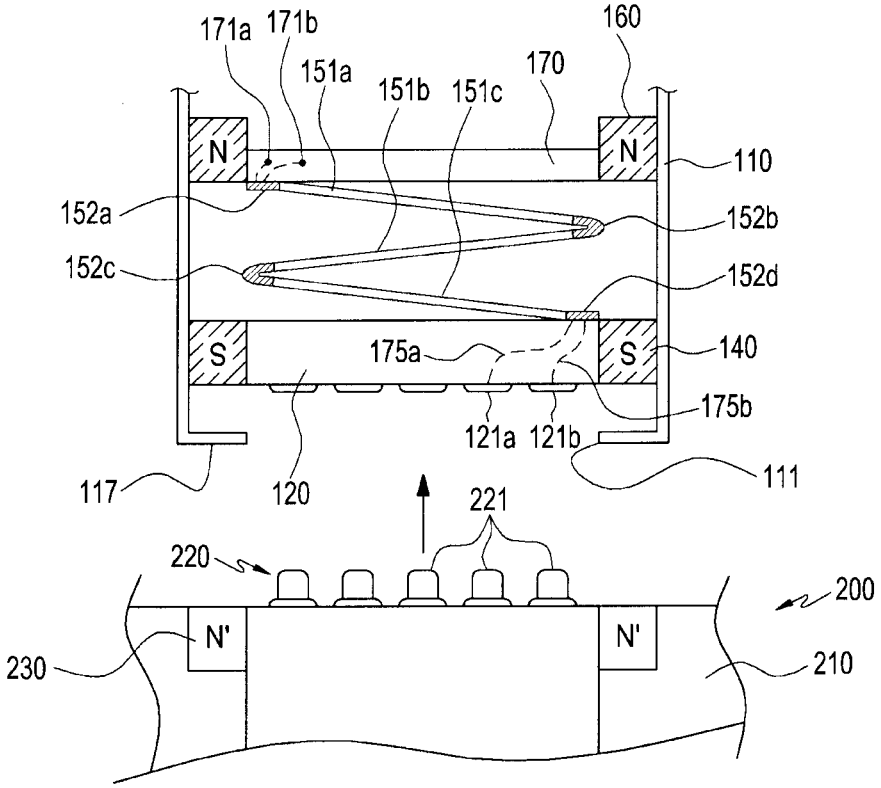
FIG. 11 is a view illustrating a wearable electronic device according to one of various embodiments of the present disclosure and an external device which approaches the wearable electronic device.

FIG. 10 is a view illustrating a state in which an external device is coupled to a wearable electronic device according to one of various embodiments of the present disclosure. FIG. 11 is a view illustrating a wearable electronic device according to one of various embodiments of the present disclosure and an external device which approaches the wearable electronic device.

Referring to FIGS. 10 and 11, as described above, the movable part 140 is provided such that the connection terminal 120 is moved outwardly, from the circuit board 170 toward the opening 111. Movable part 140 may be moved between the circuit board 170 and the opening 111 by magnetic attractive of the first member 160 and the second member 230. When external device 200 is detached from device 100 (e.g., as shown in FIG. 6), the magnets of movable part 140 and first member 160 attract, whereby movable part 140 is pulled inward from the rear surface 117 of body 110. In this state, the connection board 150 is folded, and the connection terminal 120 is proximate the circuit board 170 and is located inside the body 110.

While the external device 200 approaches device 100, the movable part 140 may be separated from the first member 160, may be moved toward the second member 230 of the external device 200 as device 200 is placed proximate to device, 100, i.e., brought close to or in contact with rear surface 117 of body 110. Connection terminal 120 may thus be attached to the second member 230 due to a driving force generated between the second member 230 and the movable part 140. When device 200 is placed proximate device 100, the connection board 150 is unfolded in stages, and the connection terminal 120 may be moved toward the opening 111 to be exposed to a rear surface 117 of body 110 through the opening 111 and may contact the terminal module 220 of the external device 200.

The first member 160 and the second member 230 may provide respective driving forces such that the movable part 140 may be fixed or moved. In detail, the movable part 140 according to an example may include a magnet member S (hereinafter, referred to as a first magnet S). (Hereafter, for brevity, "magnet" refers to a magnet member and may be any structure that includes magnetic material.) The first member 160 may include a magnet "N" (hereinafter, referred to as second magnet N) or metal reacting with the first magnet such that an attractive force with magnet S may be generated. The second member 230 may include a magnet N'(hereinafter, referred to as a third magnet) such that the second member 230 may be moved toward the opening 111 by pulling the first magnet S.

In an example, a magnetic force of the third magnet N' is larger than a magnetic force of the second magnet N. As such, the third magnet N' may uncouple the first magnet S and the second magnet N. When the magnets N and S uncouple, magnet S moves towards magnet N' as seen in FIG. 10, thereby moving the moving part 140 and connection terminal 120 towards connector 220.

If the first magnet S is attached to the second magnet N by a magnetic force, the connection terminal 120 will be located close to the circuit board 170 inside the body 110. If the external device 200 is mounted to a rear surface of the body 110, the first magnet S may be separated from the second member by a magnetic force of the third magnet N' and the connection terminal 120 may be moved from the circuit board 170 toward the opening 111 as the first magnet S is moved. The external device 200 may remain attached to rear surface 117 while the first magnet Sand the third magnet N' are attracted to one another by magnetic force (and each held against opposite surfaces of the rear wall of body 110). In this state, connection terminal 120 may be exposed to a surface of the opening 111 and may contact the terminal module 220 of the external device 200 to be electrically connected to the terminal module 220.

As shown in FIG. 11, each terminal 121 may individually connect to a different circuit node of the board 170. Each of the boards and flex boards of connection board 150 may be a circuit board with multiple isolated lines, where each line may be part of an electrical connection path between one terminal 121 to one circuit node on the board 170. For example, connection terminals 121*a* and 121*b* may connect to circuit nodes 171*a* and 171*b*, respectively, of the circuit board 170. These connections may be made through circuit paths such as 175*a*, 175*b* within the connection terminal 120, which in turn connect to respective nodes of the board 152*d*. Suitable connection through the boards 151*a*, 151*b*, 151*c*, 152*a*, 152*b* and 152*d* is then made between the respective nodes on board 152*d* to the nodes 171*a*, 171*b* to complete the connections to terminals 121*a*, 121*b*, respectively.

Although it has been exemplified that the movable part 140, the first member 160, and the second member 230 according to the above-described examples include a first magnet, a second magnet, and a third magnet, respectively, the present disclosure is not limited thereto.

For example, as another embodiment of an arrangement between the movable part 140, the first member 160, and the second member 230, the first member 160 may include a second magnet, the movable part 140 may include a metal member, and the second member 230 may include a third magnet. Meanwhile, in this case, a magnetic force of the third magnet N' may be larger than a magnetic force of the second magnet N. Accordingly, the movable part 140 formed of a metal member may be attached to the second magnet N by a magnetic force of the second magnet N. If the third magnet member is brought proximate or on rear surface 117, the metal may be separated from the second magnet N by a magnetic force of the third magnet N', and as a consequence may be moved towards the third magnet N', and may be attached to the rear wall of body 110 via the attractive force of the third magnet.

If the metal member is attached to the second magnet N by a magnetic force, the connection terminal 120 will be located close to the circuit board inside the body 110. If the external device 200 is mounted to a rear surface of the body 110, the metal member may be separated from the second member by a magnetic force of the third magnet N' and the connection terminal 120 may be moved from the circuit board 170 toward the opening 111 as the metal is moved. The external device 200 may remain attached to rear surface 117 while the metal member and the third magnet N' are held against the rear wall of body 117 by a magnetic force, and the connection terminal 120 may be exposed to a surface of the opening 111 and may contact the terminal module 220 of the external device 200 to be electrically connected to the terminal module 220.

As another embodiment of an arrangement between the movable part 140, the first member 160, and the second member 230, the first member 160 may include a metal member, the movable part 140 may include a first magnet, and the second member 230 may include a third magnet. Meanwhile, even in this case, a magnetic force of the third magnet may be larger than a magnetic force of the first magnet. Accordingly, the first magnet may be attached and attached to the metal member by a magnetic force of the first magnet. If the third magnet is located on a rear surface of the body 110 by mounting the external device 200 on a rear surface of the body 110, the first magnet may be separated from the metal by a magnetic force of the third magnet, may be moved to the third magnet, and may be attached to the third magnet. As a result, electrical connection between connection terminals 120 and 220 may be achieved as in the above cases.

While the exemplary embodiments described herein have been particularly shown and described with reference to certain examples, it will be understood by those of ordinary skill in the art that various changes in form and details may be made therein without departing from the spirit and scope of the claimed subject matter as defined by the following claims.

What is claimed is:

1. A wearable electronic device comprising:

a body having a circuit board;

a connection terminal located inside the body, the connection terminal having a plurality of terminals;

a movable part coupled to or integrated with the connection terminal and configured to move the connection terminal from the inside towards a surface of the body; and a movable connection board provided between the connection terminal and the circuit board, and configured to electrically connect the plurality of terminals and the circuit board, the movable connection board being moved as the connection terminal is moved.

2. An electronic device comprising:

a body having an opening;

a circuit board provided inside the body;

a connection terminal located inside the body, the connection terminal having a plurality of terminals electrically connected to the circuit board, and configured to be moved from inside the body to the opening; and a movable part coupled to or integrated with the connection terminal and configured to move the connection terminal from inside the body to the opening;

wherein the movable part is provided between a lateral side of the connection terminal and the body.

3. The electronic device of claim 2, further comprising a movable connection board provided between the connection terminal and the circuit board, and configured to electrically connect the connection terminal and the circuit board, the movable connection board being moved as the connection terminal is moved.

4. The electronic device of claim 3, wherein the connection board comprises:

at least one first board part; and a flexible second board part electrically connected to the first board part and configured to move the first board part between the circuit board and the connection terminal.

5. The electronic device of claim 2, further comprising a first member provided inside the body and configured to generate an attractive force to the movable part to detachably fix the movable part to the first member.

6. The electronic device of claim 5, further comprising an external device provided on a rear surface of the body to be attached to the rear surface of the body to be electrically connected to the connection terminal, and detached from the rear surface to be disconnected from the connection terminal, and configured to move the connection terminal toward the opening.

7. The electronic device of claim 6, wherein the external device comprises:

a terminal module electrically connectable to the connection terminal; and a second member provided at a periphery of the terminal module, configured to separate the movable part attached to the first member and move the movable part toward the opening, and attached to the movable part.

8. The electronic device of claim 7, wherein if the external device is provided on the rear surface of the body while the movable part is attached to the first member, the movable part is separated from the first member by the second member, moved towards the second member and fixed adjacent to the second member.

9. The electronic device of claim 8, wherein the movable part comprises a first magnet member, the first member comprises a second magnet member configured to generate an attractive force with the first magnet member, the second member comprises a third magnet member configured to generate an attractive force between the first magnet member, and the third magnet member has a magnetic force larger than that of the second magnet member.

10. The electronic device of claim 8, wherein the movable part comprises a metal member, the first member comprises a second magnet member configured to generate an attractive force with the metal member, the second member comprises a third magnet member configured to generate an attractive force between the metal member, and the third magnet member has a magnetic force larger than that of the second magnet member.

11. The electronic device of claim 8, wherein the movable part comprises a first magnet member, the first member comprises a metal member fixed in place due to a magnetic force of the first magnet member, the second member comprises a third magnet member configured to generate an attractive force between the first magnet member, and a magnetic force between the first magnet member and the third magnet member is larger than a magnetic force between the first magnet member and the metal member.

12. The electronic device of claim 9, wherein when the external device is brought proximate the rear surface of the body, the movable part is separated from the first member, moved to the surface of the body and fixed in place adjacent to the second member, and the connection terminal is exposed from the circuit board to a region of the opening to be electrically connected to the terminal module as the movable part is moved.

13. The electronic device of claim 2, wherein a cover is further provided in the opening.

14. The electronic device of claim 13, wherein the opening is an opening of one wall of the body, and the cover is provided at the opening to be attached to or detached from the opening.

15. The electronic device of claim 14, wherein the cover comprises:

an adhering member introduced into the opening and configured to seal the opening; and a bottom member provided on one surface of the adhering member and extending to a circumference of the adhering member to be attached to a periphery of the opening such that the opening is sealed.

16. The electronic device of claim 14, wherein the cover is formed of a rubber material.

* * * * *